US010996606B2

(12) United States Patent
Ieiri

(10) Patent No.: US 10,996,606 B2
(45) Date of Patent: May 4, 2021

(54) REMAINING TONER AMOUNT DETECTING APPARATUS, IMAGE FORMING APPARATUS, AND REMAINING TONER AMOUNT DETECTING METHOD

(71) Applicant: Yuji Ieiri, Kanagawa (JP)

(72) Inventor: Yuji Ieiri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/713,324

(22) Filed: Dec. 13, 2019

(65) Prior Publication Data

US 2020/0201229 A1 Jun. 25, 2020

(30) Foreign Application Priority Data

Dec. 19, 2018 (JP) ..... JP2018-237761

(51) Int. Cl.
*G03G 15/00* (2006.01)

(52) U.S. Cl.
CPC ..... *G03G 15/556* (2013.01)

(58) Field of Classification Search
CPC ..... G03G 15/556
USPC ..... 399/27
See application file for complete search history.

(56) References Cited

U.S. PATENT DOCUMENTS 7,789,475 B2 9/2010 Morishita et al.
7,819,492 B2 10/2010 Watanabe et al.
8,764,143 B2 7/2014 Ieiri
8,814,302 B2 8/2014 Ieiri
9,054,545 B2 6/2015 Ieiri
9,162,443 B2 10/2015 Ieiri
9,366,994 B2 6/2016 Shinohara et al.
2013/0266329 A1* 10/2013 Otani ..... G03G 15/086 399/27
2013/0279921 A1* 10/2013 Kanai ..... G03G 15/50 399/12
2020/0033752 A1* 1/2020 Kubo ..... G03G 15/0851

FOREIGN PATENT DOCUMENTS

JP 2002-132038 5/2002
JP 2004-093699 3/2004
JP 2016-071299 5/2016

* cited by examiner

*Primary Examiner* — Walter L Lindsay, Jr.
*Assistant Examiner* — Philipmarcus T Fadul
(74) *Attorney, Agent, or Firm* — IPUSA, PLLC

(57) ABSTRACT

A remaining toner amount detecting apparatus includes two electrodes; a remaining toner amount detector configured to detect a remaining toner amount in a toner container based on a capacitance between the two electrodes; a storage configured to store a first capacitance value between the two electrodes preliminarily detected in a non-disposed state in which the toner container is not disposed between the two electrodes; and an abnormality detector configured to detect an abnormality of the remaining toner amount detecting apparatus based on the first capacitance value stored in the storage and a second capacitance value between the two electrodes that is detected in the non-disposed state.

9 Claims, 13 Drawing Sheets

REMAINING TONER AMOUNT DETECTING APPARATUS, IMAGE FORMING APPARATUS, AND REMAINING TONER AMOUNT DETECTING METHOD

CROSS-REFERENCE TO RELATED APPLICATION

The present application is based on and claims priority under 35 U.S.C. § 119 to Japanese Patent Application No. 2018-237761, filed on Dec. 19, 2018, the contents of which are incorporated herein by reference in their entirety.

BACKGROUND OF THE INVENTION

1. Field of the Invention

The present invention relates to a remaining toner amount detecting apparatus, an image forming apparatus, and a remaining toner amount detecting method.

2. Description of the Related Art

In the related art, there is known an electrophotographic image forming apparatus that includes a pair of electrodes and that detects the remaining amount of toner in a toner container based on the capacitance between the two electrodes.

Further, there is described a technique of correcting a capacitance value based on the temperature and humidity detected by an environment sensor provided in the main body of the apparatus, in order to detect the remaining amount of toner with high accuracy regardless of the variation in the environmental conditions (see, for example, Patent Document 1).

Further, there is disclosed a technique of using two capacitance detecting circuits having different sensitivities, in order to distinguish between a state in which the remaining amount of toner in a process cartridge is low and a state in which the process cartridge is not mounted to the image forming apparatus, etc. (see, for example, Patent Document 2).

Patent Document 1: Japanese Unexamined Patent Application Publication No. 2002-132038

Patent Document 2: Japanese Unexamined Patent Application Publication No. 2004-093699

SUMMARY OF THE INVENTION

According to one aspect of the present invention, there is provided a remaining toner amount detecting apparatus including two electrodes; a remaining toner amount detector configured to detect a remaining toner amount in a toner container based on a capacitance between the two electrodes; a storage configured to store a first capacitance value between the two electrodes preliminarily detected in a non-disposed state in which the toner container is not disposed between the two electrodes; and an abnormality detector configured to detect an abnormality of the remaining toner amount detecting apparatus based on the first capacitance value stored in the storage and a second capacitance value between the two electrodes that is detected in the non-disposed state.

DETAILED DESCRIPTION OF THE PREFERRED EMBODIMENTS

Figure 1:
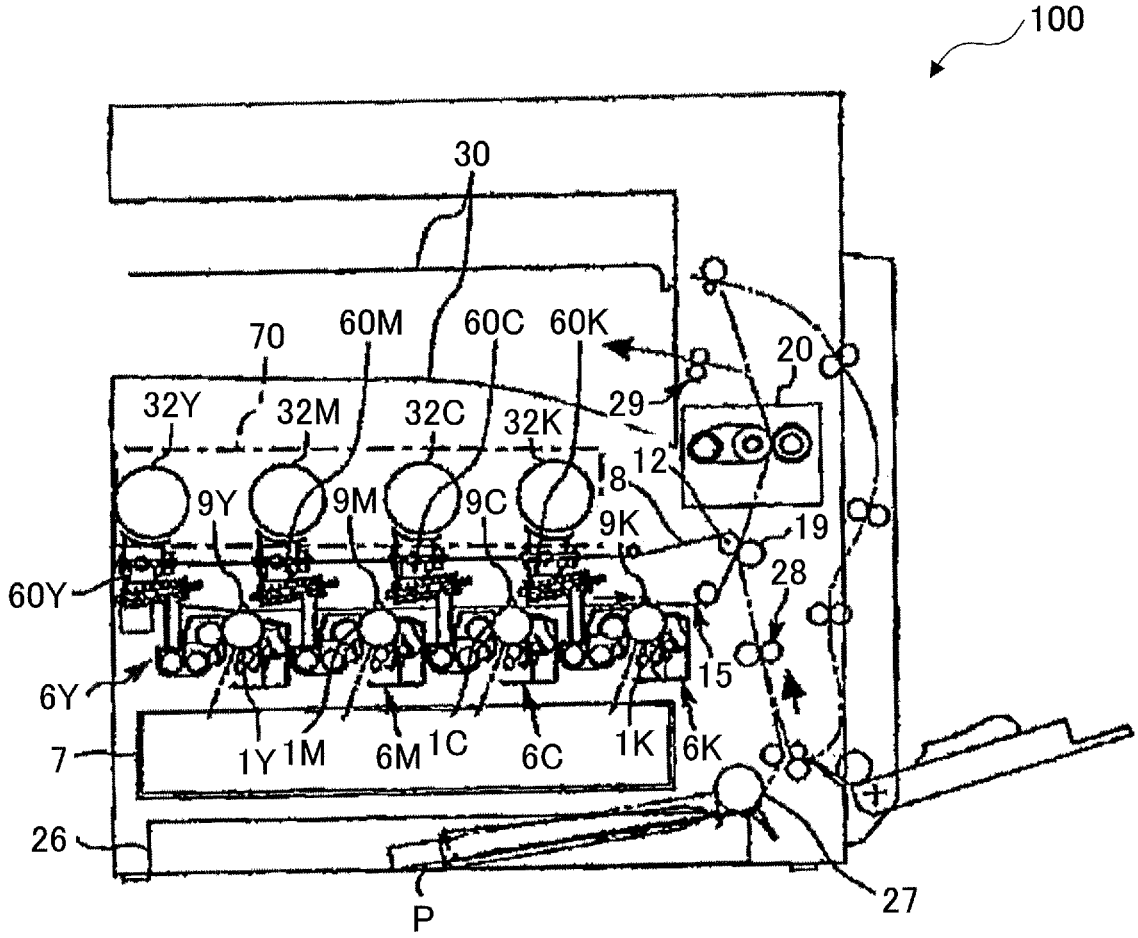
FIG. 1 is a FIG. 1 is a diagram illustrating an example of a configuration of an image forming apparatus according to an embodiment of the present invention.

In the techniques described in Patent Documents 1 and 2, there are instances where the capacitance cannot be accurately detected and the remaining amount of toner cannot be accurately determined, because a foreign object that is not a detection target (such as toner spilled from the toner container) is interposed between the two electrodes and thereby causes a variation in the capacitance.

A problem to be addressed by an embodiment of the present invention is to detect an abnormality in which a variation in the capacitance is caused, because a foreign object that is not a detection target is interposed between two electrodes, in an apparatus for detecting the remaining amount of toner in a toner container based on the capacitance between the two electrodes.

Hereinafter, an embodiment for carrying out the present invention will be described with reference to the drawings. In the drawings, the same elements are denoted by the same reference numerals and overlapping descriptions may be omitted.

A recording medium according to the embodiment is a paper sheet, a plastic sheet, and the like. Hereinafter, the case where the recording medium is a paper sheet will be described as an example. Further, an image forming apparatus including a remaining toner amount detecting apparatus according to the embodiment will be described as an example.

Note that it is assumed that image forming and printing used as the terms in the embodiment are synonymous.

Configuration of the Image Forming Apparatus According to Embodiment

FIG. 1 is a diagram illustrating an example of a configuration of an image forming apparatus 100 according to an embodiment.

The image forming apparatus 100 includes a toner container housing unit 70, an intermediate transfer unit 15, an image forming unit 6 for each toner color, and a toner supplying unit 60 for each toner color. In the toner container housing unit 70, four toner containers 32 (32Y, 32M, 32C, and 32K) corresponding to the respective colors (yellow, magenta, cyan, and black) are disposed in a detachably attached (replaceable) manner.

In FIG. 1, the intermediate transfer unit 15 is provided below the toner container housing unit 70. The image forming units 6 (6Y, 6M, 6C, and 6K) corresponding to the respective colors are disposed in parallel so as to face an intermediate transfer belt 8 of the intermediate transfer unit 15.

The toner supplying units 60 (60Y, 60M, 60C, and 60K) are provided below the toner containers 32 (32Y, 32M, 32C, and 32K), respectively. The toner contained in the toner container 32 (32Y, 32M, 32C, and 32K) is supplied into a developing unit 5 (FIG. 2) of the corresponding image forming unit 6 (6Y, 6M, 6C, and 6K) by the corresponding toner supplying unit (60Y, 60M, 60C, and 60K).

The four toner containers 32 (32Y, 32M, 32C, and 32K), the four image forming units 6 (6Y, 6M, 6C, and 6K), and the four toner supply units 60 (60Y, 60M, 60C, and 60K) corresponding to the respective colors have the same configuration except that the colors of the toner to be used are different. Therefore, in the following descriptions and drawings, the subscripts "Y", "M", "C", and "K" representing the color of the toner to be used are omitted as appropriate.

Figure 2:
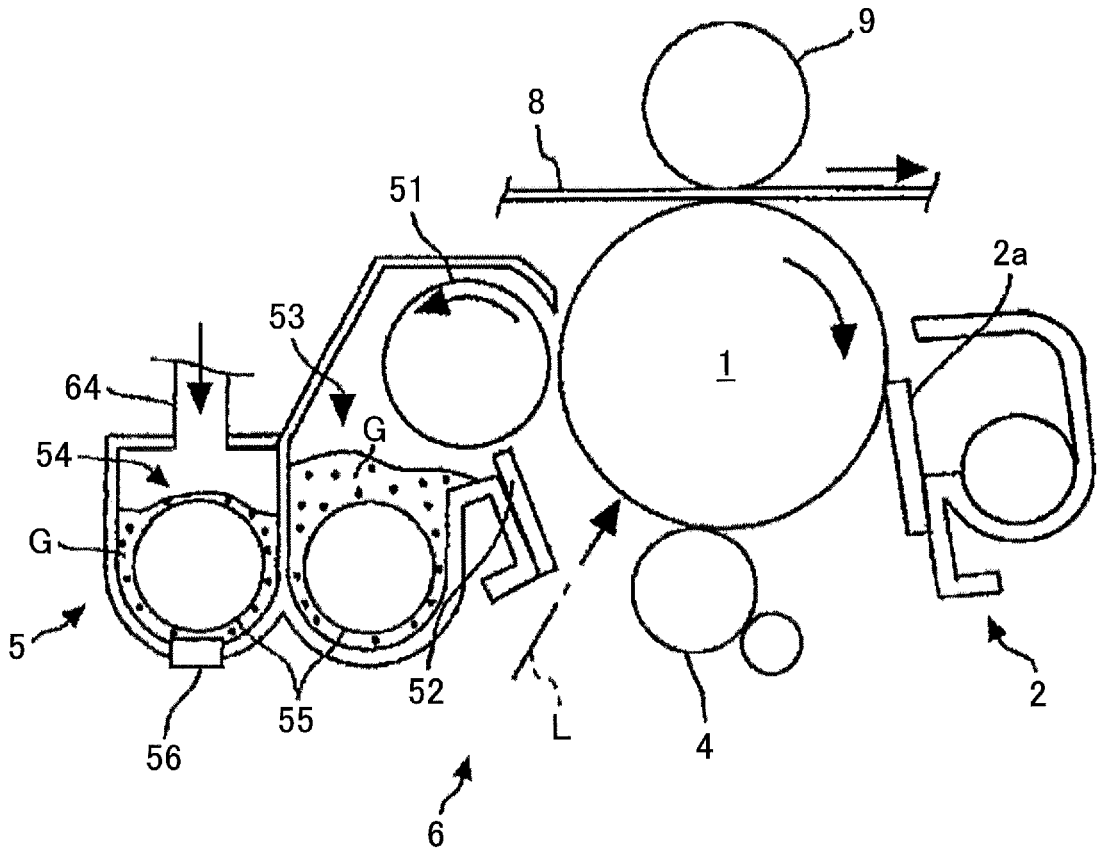
FIG. 2 is a diagram illustrating an example of a configuration of an image forming unit according to an embodiment of the present invention.

FIG. 2 is a diagram illustrating an example of a configuration of one of the four image forming units 6.

The image forming unit 6 includes a photoconductor 1, a charging unit 4 disposed around the photoconductor 1, the developing unit 5, a cleaning unit 2, and a neutralizing unit. An image of each color is formed on the photoconductor 1 by performing an image formation process on the photoconductor 1, that is, a charging process, an exposure process, a development process, a transfer process, and a cleaning process.

The photoconductor 1 is driven to rotate in the direction of the arrow (the clockwise direction) illustrated in the photoconductor 1 of FIG. 2 by a driving motor. At the position of the charging unit 4, the surface of the photoconductor 1 is uniformly charged (the charging process). Subsequently, the surface of the photoconductor 1 reaches the irradiation position of a laser light L emitted from an exposure unit 7 (FIG. 1), and an electrostatic latent image corresponding to each color is formed by exposure scanning at the irradiation position (the exposure process).

Subsequently, the surface of the photoconductor 1 reaches a position facing the developing unit 5, and the electrostatic latent image is developed at this position, so that a toner image of each color is formed (the developing process). Subsequently, the surface of the photoconductor 1 reaches a primary transfer portion facing a primary transfer roller 9 with the intermediate transfer belt 8 interposed therebetween, and the toner image on the surface of the photoconductor 1 is transferred onto the intermediate transfer belt 8 at the primary transfer portion (the primary transfer process). The toner images of the respective colors formed on the corresponding photoconductors 1 of the respective colors are transferred onto the intermediate transfer belt 8 so as to overlap each other, thereby forming a color image on the intermediate transfer belt 8.

A small amount of untransferred toner remains on the surface of the photoconductor 1 that passed through the primary transfer portion. Subsequently, the surface of the photoconductor 1 reaches a position facing the cleaning unit 2, and the untransferred toner remaining on the photoconductor 1 is mechanically collected by a cleaning blade 2*a* (the cleaning process). Finally, the surface of the photoconductor 1 reaches a position facing the neutralizing unit and the residual potential on the photoconductor 1 is removed.

The intermediate transfer unit 15 includes the intermediate transfer belt 8, the four primary transfer rollers 9 (9Y, 9M, 9C, and 9K), a secondary transfer backup roller 12, a plurality of tension rollers, and an intermediate transfer cleaning unit. The intermediate transfer belt 8 is stretched and supported by a plurality of stretching rollers; also, the intermediate transfer belt 8 is endlessly moved in the direction of the arrow (the counterclockwise direction) illustrated with respect to the intermediate transfer belt 8 in FIG. 1, by the rotation driving of the secondary transfer backup roller 12 among the roller members. Each of the four primary transfer rollers 9 (9Y, 9M, 9C, and 9K) sandwiches the intermediate transfer belt 8 with the corresponding photoconductor 1 (1Y, 1M, 10, and 1K) to form a primary transfer nip.

Further, a transfer bias opposite to the polarity of the toner is applied to the primary transfer roller 9 (9Y, 9M, 9C, and 9K). The intermediate transfer belt 8 travels in the direction of the arrow illustrated with respect to the intermediate transfer belt 8 of FIG. 1 and sequentially passes through the primary transfer nips of the respective primary transfer rollers 9 (9Y, 9M, 9C, and 9K). In this way, the toner images of the respective colors on the photoconductors 1 (1Y, 1M, 1C, and 1K) are superimposed and primary-transferred on the intermediate transfer belt 8.

The portion of the intermediate transfer belt 8 on which the toner images of the respective colors have been superimposed and primary-transferred, reaches a secondary transfer portion facing a secondary transfer roller 19. At the secondary transfer portion, the intermediate transfer belt 8 is sandwiched between the secondary transfer backup roller 12 and the secondary transfer roller 19 such that a secondary transfer nip is formed. The four-color toner image formed on the intermediate transfer belt 8 is secondary-transferred onto a recording medium P, such as a transfer sheet, conveyed to the position of the secondary transfer nip.

At this time, the untransferred toner that was not transferred to the recording medium P remains on the intermediate transfer belt 8. Subsequently, the intermediate transfer belt 8 reaches the position of the intermediate transfer cleaning unit and the untransferred toner remaining on the intermediate transfer belt 8 is collected. In this way, the series of transfer processes performed on the intermediate transfer belt 8 is completed.

The recording medium P conveyed to the position of the secondary transfer nip is conveyed from a sheet feeding unit 26 disposed at the lower portion of the image forming apparatus 100 through a sheet feeding roller 27, a pair of resist rollers 28 (the resist roller pair 28), and the like.

Specifically, a plurality of recording media P is stacked in the sheet feeding unit 26. When the sheet feeding roller 27 is driven to rotate in the counterclockwise direction in FIG. 1, the top recording medium P is fed towards the portion between the two resist rollers 28.

The recording medium P conveyed to the resist roller pair 28 temporarily stops at the roller nip of the resist roller pair 28 that has stopped being driven to rotate. Then, at a timing to coincide with the color image on the intermediate transfer belt 8, the resist roller pair 28 is driven to rotate and the recording medium P is conveyed toward the secondary transfer nip. In this way, the desired color image is transferred onto the recording medium P.

The recording medium P on which the color image has been transferred at the secondary transfer nip, is conveyed to a fixing unit 20. At this position, the color image transferred onto the surface of the recording medium P is fixed to the recording medium P by heat and pressure applied by a fixing belt and a pressurizing roller.

Subsequently, the recording medium P passes between two paper ejecting rollers 29, and is discharged to the outside of the apparatus. The recording medium P, discharged outside the apparatus by the paper ejecting roller pair 29, is sequentially stacked on a stack portion 30 as an output image. In this way, a series of image forming processes in the image forming apparatus 100 is completed.

Next, the configuration and operation of the developing unit in the image forming unit will be described in further detail.

As illustrated in FIG. 2, the developing unit 5 includes a developing roller 51 facing the drum-shaped photoconductor 1, a doctor blade 52 facing the developing roller 51, and two conveying screws 55 respectively disposed in a first developer housing unit 53 and a second developer housing unit 54. Further, a toner density detecting sensor 56 for detecting the toner density in the developer in the first developer housing unit 53 is also provided.

The developing roller 51 includes a magnet fixed inside and a sleeve that rotates around the magnet, etc. A two-component developer G configured by carriers and toner is housed inside the first developer housing unit 53 and the second developer housing unit 54. The second developer housing unit 54 is in communication with a toner dropping conveying path 64 via an opening formed above the second developer housing unit 54.

The sleeve of the developing roller 51 is driven to rotate in the direction of the arrow (the counterclockwise direction) illustrated in the developing roller 51 in FIG. 2. The developer G, which is carried on the developing roller 51 by a magnetic field formed by the magnet, moves on the developing roller 51 as the sleeve rotates.

In the developer G in the developing unit 5, the ratio of the toner in the developer (toner density) is adjusted so as to be within a predetermined range. In accordance with the toner consumption in the developing unit 5, the toner contained in the toner container 32 is supplied to the second developer housing unit 54 via the toner supplying unit 60. The configuration and operation of the toner supplying unit 60 will be described in detail below.

The toner supplied in the second developer housing unit 54 circulates in the first developer housing unit 53 and the second developer housing unit 54 while being mixed and stirred with the developer G by the two conveying screws 55. Further, the toner in the developer G is attracted to the carriers by friction charging with respect to the carriers, and is carried on the developing roller 51 together with the carriers by a magnetic force formed on the developing roller 51. The developer G carried on the developing roller 51 is conveyed in the direction of the arrow illustrated in the developing roller 51 in FIG. 2, to reach the position of the doctor blade 52.

Then, at the position of the doctor blade 52, the amount of the developer G on the developing roller 51 is optimized, and then the developer G is conveyed to a position facing the photoconductor 1 (the developing area), and toner is attracted to the latent image formed on the photoconductor 1 by an electric field formed in the developing area. Subsequently, the developer G remaining on the developing roller 51 reaches a portion above the first developer housing unit 53 as the sleeve rotates, and is separated from the developing roller 51 at this position.

Next, the toner supplying unit 60 and the toner container 32 will be described in detail.

Figure 3:
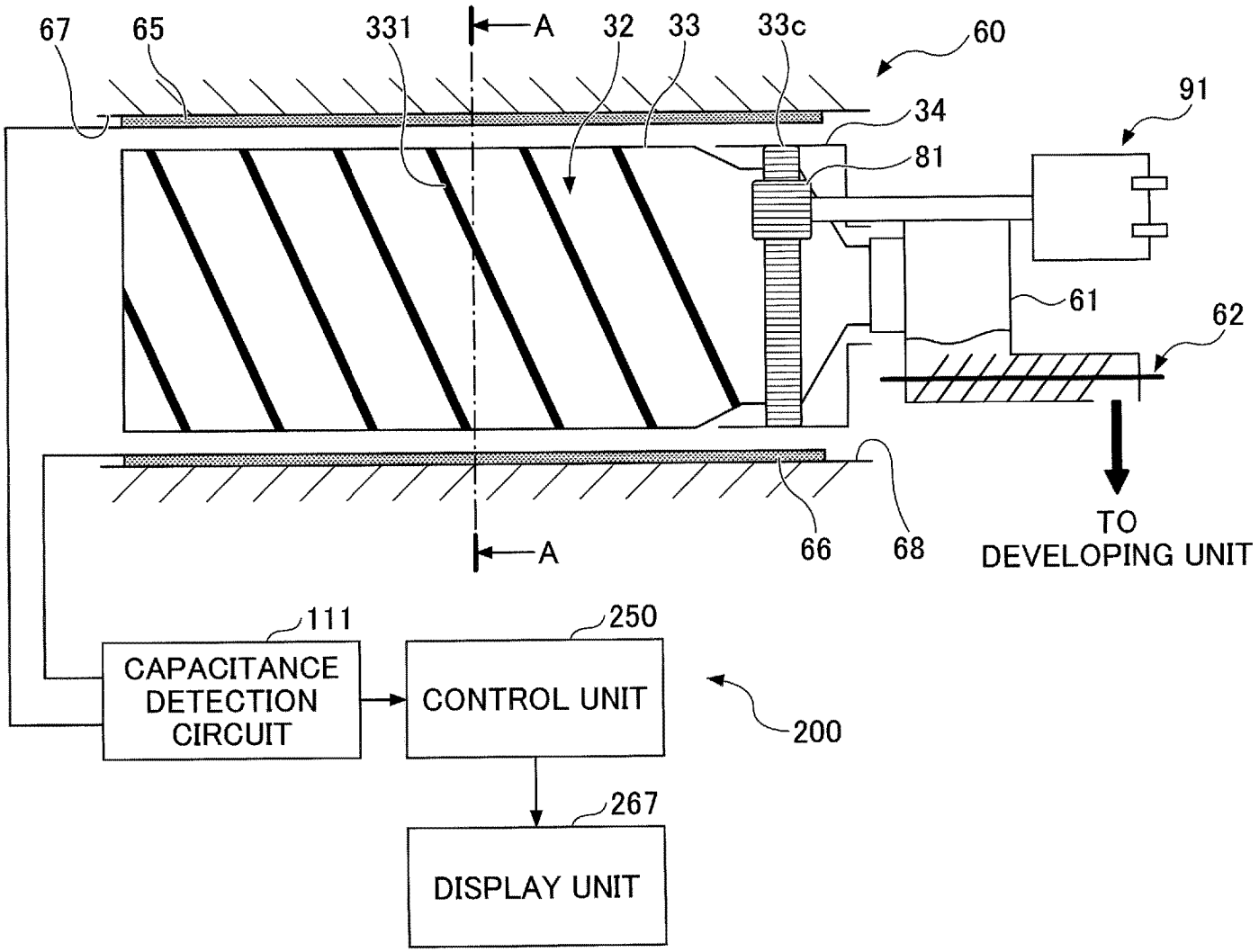
FIG. 3 is a diagram illustrating an example of a configuration of a toner supplying unit according to an embodiment of the present invention.
Figure 4:
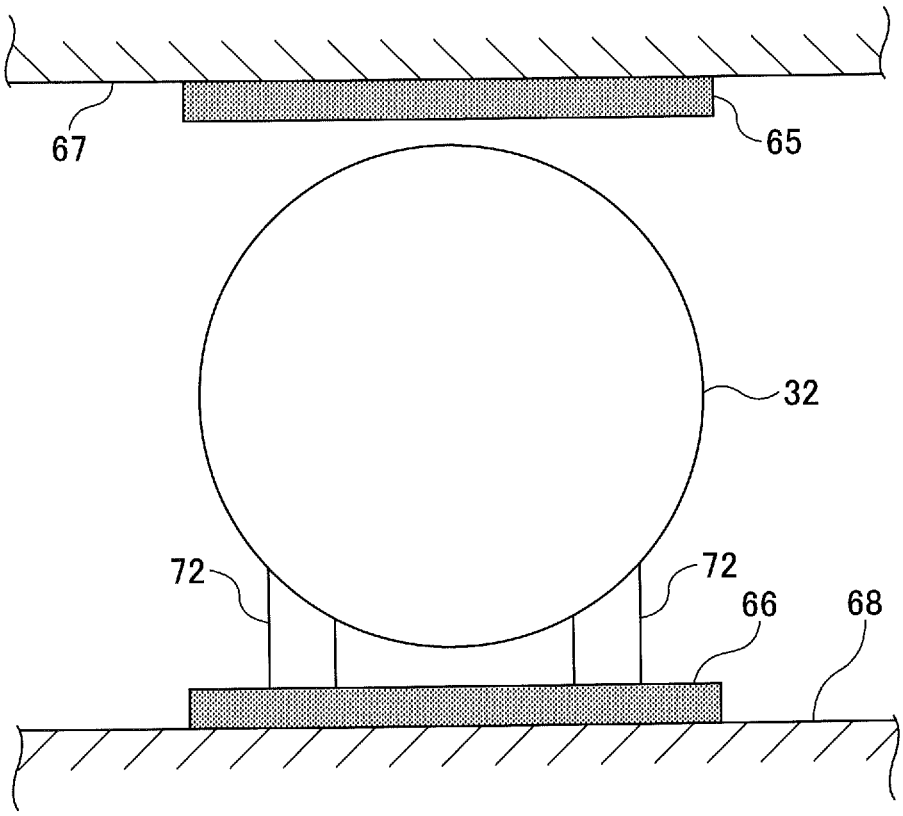
FIG. 4 is a cross-sectional view of FIG. 3 according to an embodiment of the present invention.

FIG. 3 is a diagram illustrating an example of a configuration of one of the four toner supplying units 60. FIG. 4 is a cross-sectional view along a line A-A in FIG. 3, and FIG. 5 is a perspective view illustrating an example in which the toner containers (32Y, 32M, 32C, and 32K) are disposed in the toner container housing unit 70.

The toner in the toner container 32 disposed in the toner container housing unit 70 (see FIG. 1) of the image forming apparatus 100 is appropriately supplied to the developing unit 5 of each color by the toner supplying unit 60 provided for each toner color in accordance with the toner consumption in the developing unit 5 of each color.

Figure 5:
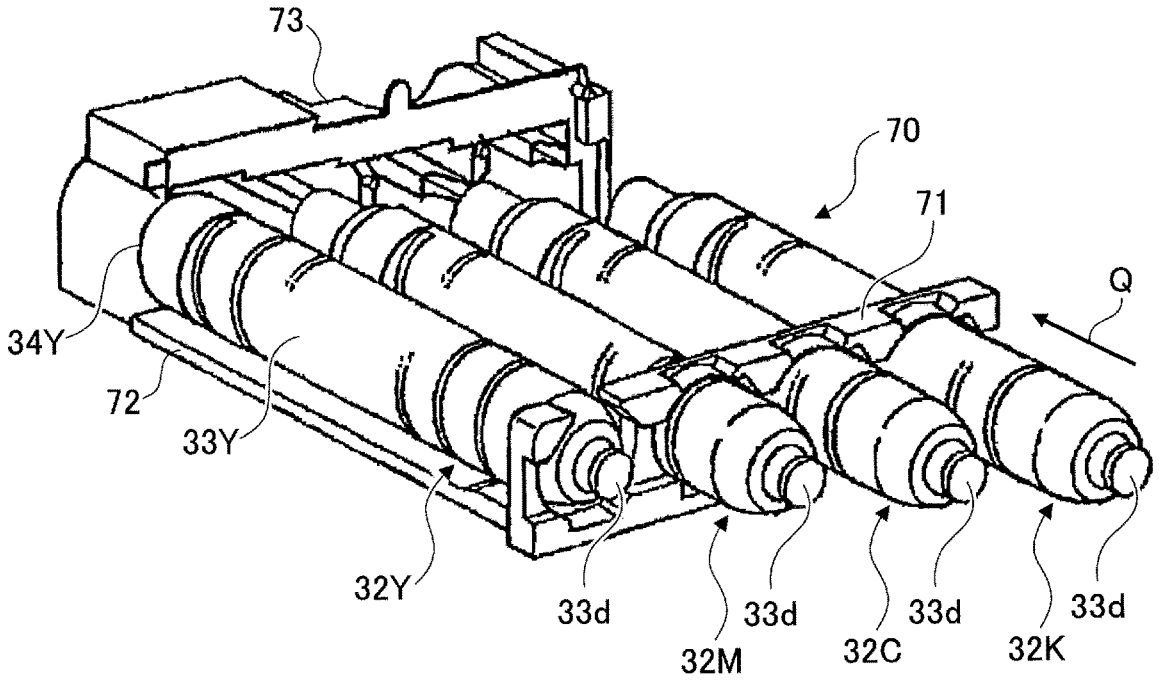
FIG. 5 is a perspective view illustrating an example of a state in which a toner container is disposed in a toner container housing unit according to an embodiment of the present invention.

The toner container 32 can be mounted to the toner container housing unit 70 by moving the toner container 32 in the direction of an arrow "Q" in FIG. 5 with respect to the toner container housing unit 70 in the main body of the image forming apparatus 100.

The toner container 32 is supported by two guide units 72 illustrated in FIG. 4. The toner container 32 is a substantially cylindrical toner bottle, including a cap 34 held in a non-rotational manner by the toner container housing unit 70 and a container body 33 having a gear 33*c* formed integrally, as illustrated in FIG. 3.

The container body 33 is rotatably held relative to the cap 34 so that the gear 33*c* is able to engage with a drive output gear 81 of the toner supplying unit 60. When a driving motor 91 rotates the drive output gear 81, a driving force is transmitted to the gear 33*c* of the container body 33, and the container body 33 can be driven to rotate while having the outer peripheral surface thereof guided by the guide units 72 (see FIG. 5).

As the container body 33 rotates, the toner contained inside the container body 33 is conveyed from the left side to the right side in FIG. 3 along the longitudinal direction of the container body 33, by a spiral projection 331 formed in a spiral manner on the inner peripheral surface of the container body 33.

The conveyed toner is discharged from the toner container 32 and supplied into a hopper unit 61 of the toner supplying unit 60. That is, when the container body 33 of the toner container 32 is driven to be rotated by the driving motor 91 as appropriate, the toner is supplied to the hopper unit 61 as appropriate. The toner container 32 (32Y, 32M, 32C, and 32K) of each color is replaced with a new toner container when the toner container 32 reaches its lifetime, for example, when almost all of the contained toner is consumed and the toner container 32 becomes empty.

As illustrated in FIG. 3, the toner supplying unit 60 includes the hopper unit 61, a toner conveying screw 62, and the driving motor 91. In the hopper unit 61, toner supplied from the toner container 32 is stored, and the toner conveying screw 62 is provided.

When a control unit detects that the toner density inside the developing unit 5 is lowered based on a detection result of the toner density detecting sensor 56 (see FIG. 2), the toner supplying unit 60 rotates the toner conveying screw 62 for a predetermined time to supply toner to the developing unit 5Y. The toner conveying screw 62 rotates to supply toner, and, therefore, by detecting the rotation speed of the toner conveying screw 62, the amount of toner supplied to the developing unit 5 can be accurately calculated.

A toner end sensor for detecting that the toner stored in the hopper unit 61 has become less than or equal to a predetermined amount, is disposed on the wall of the hopper unit 61. As the toner end sensor, a piezoelectric sensor and the like can be used. When the toner end sensor detects that the toner stored in the hopper unit 61 has become less than or equal to a predetermined amount (toner end detection), the driving motor 91 starts driving. Then, the driving motor 91 drives the container body 33 of the toner container 32 to rotate for a predetermined time to supply toner to the hopper unit 61.

In the embodiment, the hopper unit 61 is provided to temporarily store the toner discharged from the toner container 32; however, the toner discharged from the toner container 32 may be directly supplied to the developing unit 5.

Here, in the related art, there is known a technique in which the remaining amount of toner (remaining toner amount) in the toner container 32 is estimated and reported to the user. As a method of estimating the remaining toner amount of the toner container 32, there is a method of making the estimation based on the accumulated driving time of the toner conveying screw 62. The amount of toner conveyed by the toner conveying screw 62 is substantially proportional to the rotation angle (rotation time) of the toner conveying screw 62, and, therefore, by recording the total rotation time of the toner conveying screw 62, the toner usage amount can be known, and by subtracting the toner usage amount from the initial filled amount in the toner container 32, the remaining toner amount can be known. However, the amount of toner conveyed by the toner conveying screw 62 varies depending on the environment, the driving time, and the supplying frequency (supplying interval), and the like, and, therefore, the estimated remaining toner amount also varies greatly.

Further, as another method of estimating the remaining toner amount in the toner container 32, there is a method of making the estimation based on an output image pattern. The amount of toner to be used for an image to be printed out (the amount of toner adhering to the photoconductor per image area is almost constant) can be calculated, and, therefore, if the accumulated image area is known, the usage amount of toner can be known. In this method also, the toner adhering to the photoconductor varies due to various errors, and, therefore, it is difficult to determine the accurate remaining toner amount.

Configuration of Remaining Toner Amount Detecting Apparatus According to Embodiment Accordingly, in the embodiment, as illustrated in FIGS. 3 and 4, the toner container 32 is sandwiched from the outside by a pair of parallel plate electrodes 65 and 66, and almost the entire surface of the toner container 32 is covered by the pair of parallel plate electrodes 65 and 66. Specifically, the length of the parallel plate electrode in the shorter direction (the length in the left-right direction in FIG. 4) is longer than the diameter of the toner container 32, and the length of the parallel plate electrode in the longitudinal direction (the length in the left-right direction in FIG. 3) is more than half the length of the toner container.

The parallel plate electrode 65 is fixed to an upper wall surface 67 of the image forming apparatus 100 facing the toner container 32 from above the toner container 32 by double-sided tape and the like. The parallel plate electrode 66 is fixed to a lower wall surface 68 of the image forming apparatus 100 facing the toner container 32 from below the toner container 32 by double-sided tape and the like. The parallel plate electrodes 65 and 66 may be any electrically conductive member, and are iron plates in the embodiment.

The two parallel plate electrodes 65 and 66 are the same size. By making the two parallel plate electrodes 65 and 66 the same size, it is possible to prevent the variation in the density of the electric line of force between the parallel plate electrodes, and it is possible to prevent the capacitance from varying with respect to the same amount of toner, due to the uneven distribution of the toner in the toner container 32.

As illustrated in FIG. 3, a remaining toner amount detecting apparatus 200 according to the embodiment includes the parallel plate electrodes 65 and 66, which are an example of a "pair of electrodes", a capacitance detection circuit 111, a control unit 250, and a display unit 267.

The parallel plate electrodes 65 and 66 are each electrically coupled to the capacitance detection circuit 111. Power is applied from the capacitance detection circuit 111 to the pair of parallel plate electrodes 65 and 66 to detect the capacitance between the parallel plate electrodes.

The method for detecting capacitance may be a general method, and in the embodiment, the capacitance is detected by a charging method (applying a constant voltage or constant current between the electrodes and detecting capacitance based on the relationship between the time of the charge-reaching point and the voltage or the current). The capacitance detection circuit 111 outputs a signal representing the detected capacitance value to the control unit 250.

The detected capacitance varies according to the dielectric constant between the parallel plate electrodes 65 and 66. The dielectric constant of the toner is higher than that of air, and, therefore, the dielectric constant varies depending on the amount of toner in the range of the electric field between the parallel plate electrodes. Therefore, the capacitance varies depending on the remaining toner amount in the toner container 32 sandwiched by the parallel plate electrodes 65 and 66 from the outside.

Accordingly, the control unit 250 can acquire the remaining toner amount in the toner container 32 by referring to a calibration curve indicating the relationship between the capacitance acquired in advance and the remaining toner amount based on the capacitance detected by the capacitance detection circuit 111. Note that the functional configuration of the control unit 250 will be described in detail later.

The display unit 267 may display at least one of a remaining toner amount value input from the control unit 250 and a report providing an instruction to remove the cause of an abnormality.

Figure 6:
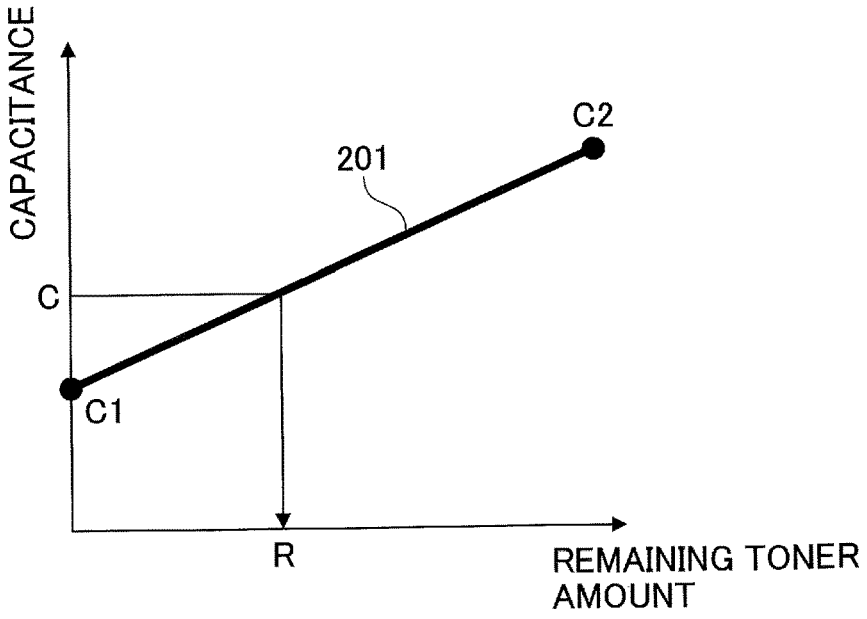
FIG. 6 is a diagram illustrating an example of a calibration curve according to an embodiment of the present invention.

FIG. 6 is a diagram illustrating an example of a calibration curve. The horizontal axis in FIG. 6 indicates the remaining toner amount and the vertical axis indicates the capacitance. When acquiring a calibration curve 201, the remaining toner amount detecting apparatus 200 detects a capacitance C1 when the toner container 32 is empty, that is, when the remaining toner amount in the toner container 32 is zero, and a capacitance C2 when the toner container 32 is full. Then, the remaining toner amount detecting apparatus 200 obtains a primary equation including the capacitance C1 and the capacitance C2, and associates the capacitance and the remaining toner amount with each other according to the primary equation, thereby acquiring the calibration curve 201.

However, the state of the remaining toner amount when acquiring the calibration curve 201 is not limited to when the toner container 32 is empty and full. The calibration curve 201 may be acquired from the capacitance in states of two or more known values of the remaining toner amount in the toner container 32.

Figure 7:
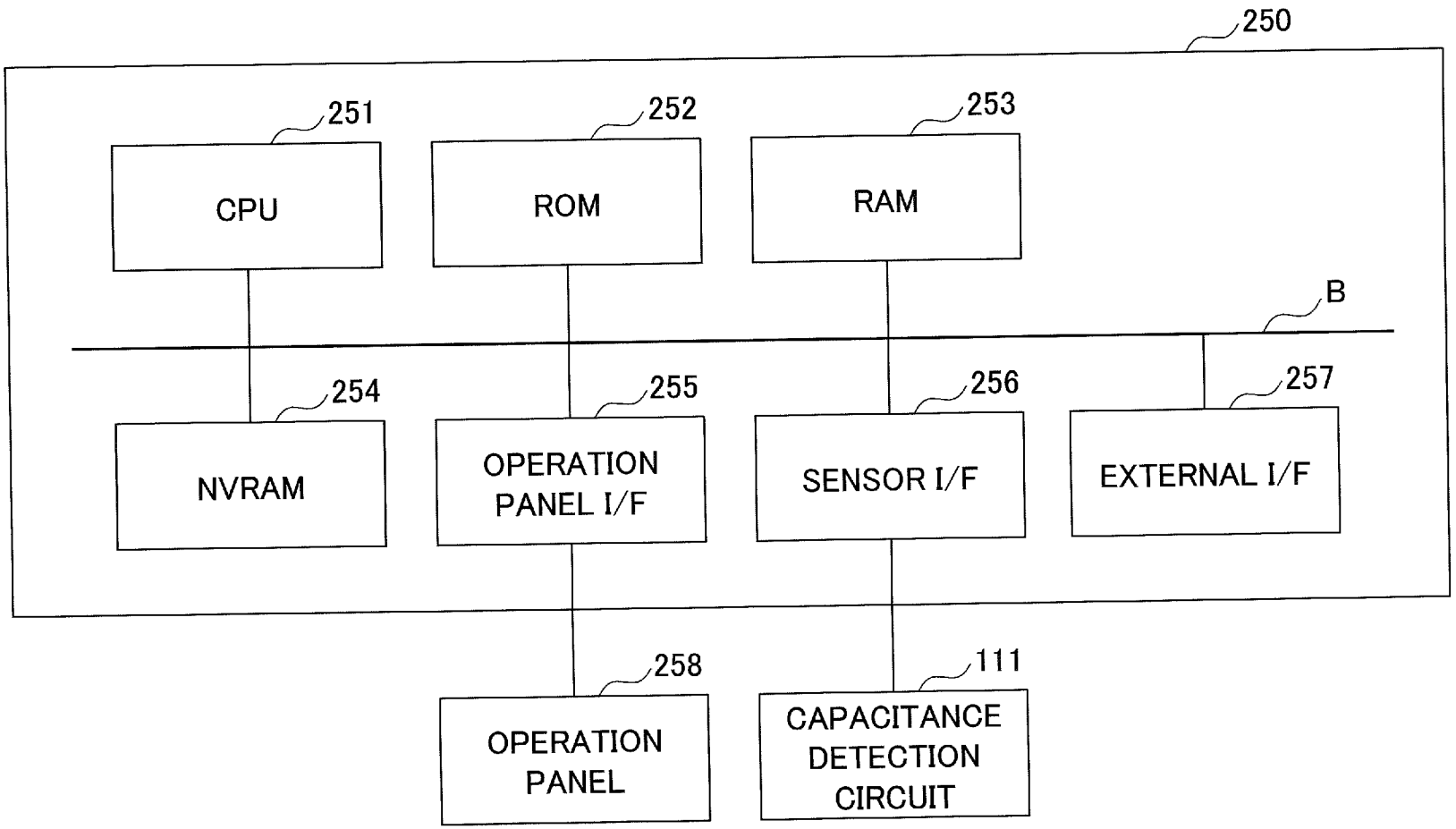
FIG. 7 is a block diagram illustrating an example of a hardware configuration of a control unit according to an embodiment of the present invention.

FIG. 7 is a block diagram illustrating an example of a hardware configuration of the control unit according to the embodiment.

The control unit 250 includes a Central Processing Unit (CPU) 251, a Read-Only Memory (ROM) 252, a Random Access Memory (RAM) 253, a Non-Volatile Random Access Memory (NVRAM) 254, an operation panel interface (I/F) 255, a sensor I/F 256, and an external I/F 257. These elements are coupled to each other via a system bus B.

The CPU 251 controls the entire remaining toner amount detecting apparatus 200 and comprehensively controls access to various devices coupled to the system bus B based on a control program and the like stored in the ROM 252. The CPU 251 executes a control program stored in the ROM 252 by using the RAM 253 as a working area, and can thus implement various functions described later.

The ROM 252 is a read-only non-volatile memory and stores a control program and control data and the like used by the CPU 251. The RAM 253 is a volatile memory capable of reading and writing information at high speed and is used as a framework memory for expanding recorded data and storing environmental data. The NVRAM 254 is a non-volatile memory in which information can be read and written, and stores information concerning the remaining toner amount detecting apparatus used by the control program.

The operation panel I/F 255 is an interface for performing data exchange between the CPU 251 and an operation panel 258 provided in the image forming apparatus 100. The operation panel 258 includes a display unit and an input unit and functions as a user interface.

The sensor I/F 256 is electrically coupled to the capacitance detection circuit 111 and is an interface for exchanging signals and data with the capacitance detection circuit 111. The external I/F 257 is an interface for exchanging signals and data with an external device such as a printer controller provided in the image forming apparatus 100.

Note that the function of the capacitance detecting circuit 111 may be implemented with software by the CPU 251 and the like, and various functions implemented by the CPU 251 and the like described later may be implemented with hardware such as an application specific circuit (ASIC) or a FPGA (Field-Programmable Gate Array).

First Embodiment

In the remaining toner amount detecting apparatus according to the embodiment, the space sandwiched between the parallel plate electrodes 65 and 66 includes not only the toner in the toner container 32 that is the detection target, but also air, the toner container 32, and a part of the toner supplying unit 60 and the like that are not the detection target. Therefore, by using a calibration curve acquired in advance, the impact of variations in the capacitance, caused by objects that are not detection targets, can be removed from the detected capacitance.

However, after acquiring the calibration curve, when a foreign object, which is not a detection target of the remaining toner amount detecting apparatus and which causes a variation in the capacitance, is interposed in the space sandwiched between the parallel plate electrodes 65 and 66, an error may occur in the detection result of the remaining toner amount due to the variation in the capacitance caused by the foreign object.

Figure 8:
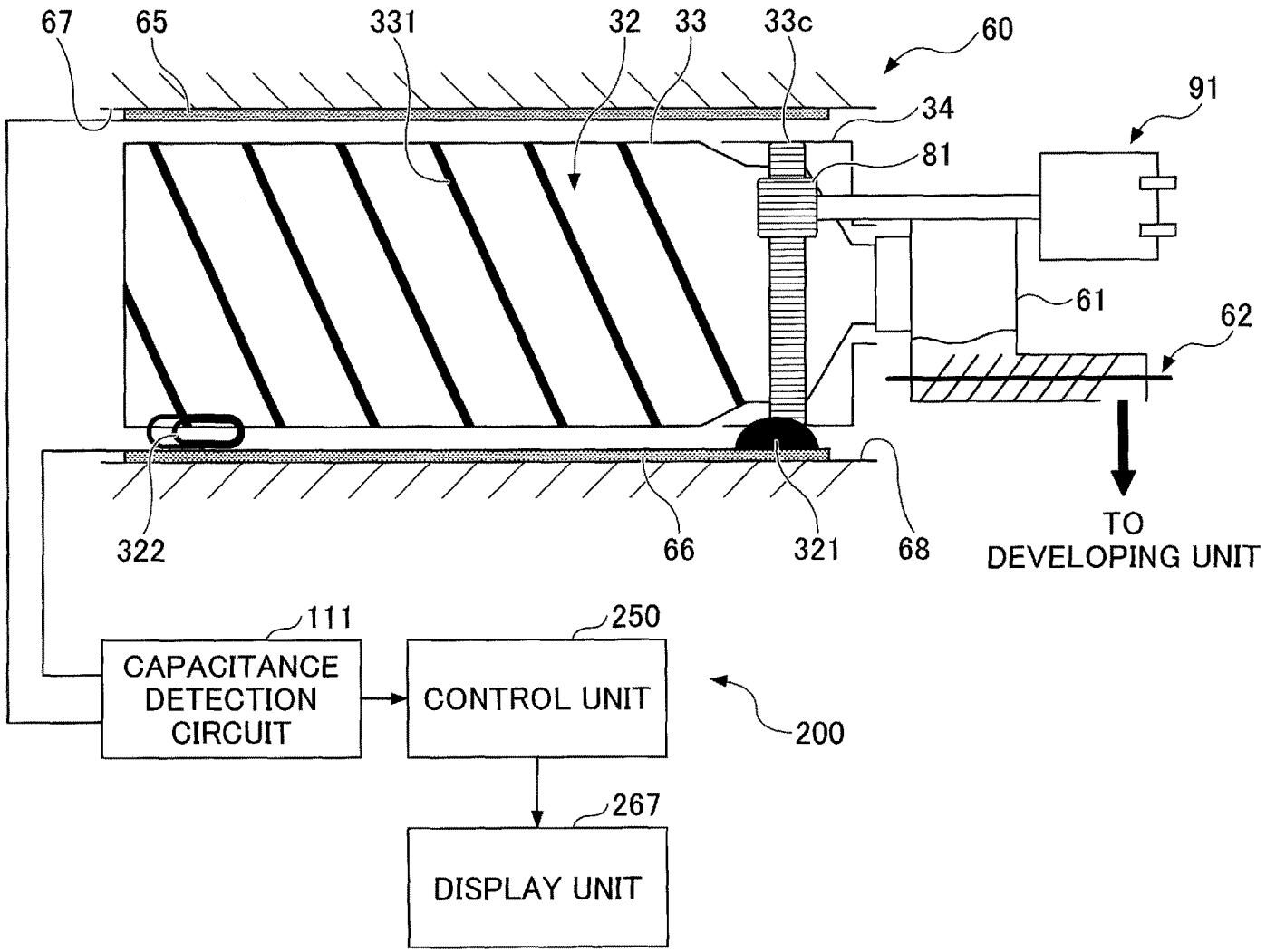
FIG. 8 is a diagram illustrating an example of a state in which a foreign object is interposed between two electrodes according to an embodiment of the present invention.

FIG. 8 is a diagram illustrating an example of a state in which a foreign object is interposed between the two electrodes. Specific examples of foreign objects include leaked toner 321 spilled from the toner container 32 and a metal piece 322, such as a clip or a staple that has entered onto the lower wall surface 68 of the image forming apparatus 100.

The toner container 32 is detachably attached to the toner container housing unit 70, and, therefore, the toner may spill from the inside of the toner container 32 at the time of attachment and detachment. The leaked toner 321 is not supplied to the developing unit 5, and, therefore, the leaked toner 321 cannot be included in the remaining toner amount. However, the leaked toner 321 causes a variation in the dielectric constant between the parallel plate electrodes 65 and 66, and thus causes an error in the detection of the capacitance.

Further, the metal piece 322, such as a clip or a staple, used to bind the recording medium P on which an image is formed, may accidentally enter onto the lower wall surface 68 of the image forming apparatus 100. The metal piece 322 causes a variation in the dielectric constant between the parallel plate electrodes 65 and 66 and thus causes an error in the detection of the capacitance.

Accordingly, in the present embodiment, an abnormality is detected when such a foreign object is interposed between the parallel plate electrodes 65 and 66. Specifically, in a non-disposed state in which the toner container 32 is not disposed between the parallel plate electrodes 65 and 66, the capacitance is detected in advance by the remaining toner amount detecting apparatus 200, and the detected value is stored as a capacitance initial value in the storage unit. Then, at the time of inspecting the image forming apparatus 100, etc., it is detected as to whether there is an abnormality in which a foreign object is interposed between the two electrodes, based on a capacitance inspection value, which is a detected value of the capacitance detected by the remaining toner amount detecting apparatus 200 in a non-disposed state, and the capacitance initial value.

Note that the above-described non-disposed state can be realized by removing the toner container 32, which is detachably attached to the toner container housing unit 70, from the toner container housing unit 70.

Further, the capacitance initial value is an example of a "stored capacitance value", and the capacitance inspection value is an example of a "capacitance value between two electrodes detected in a non-disposed state".

The above-described inspection of the image forming apparatus 100 may be a periodic inspection performed at predetermined intervals or an irregular inspection performed at any time such as when replacing the toner container 32.

Figure 9:
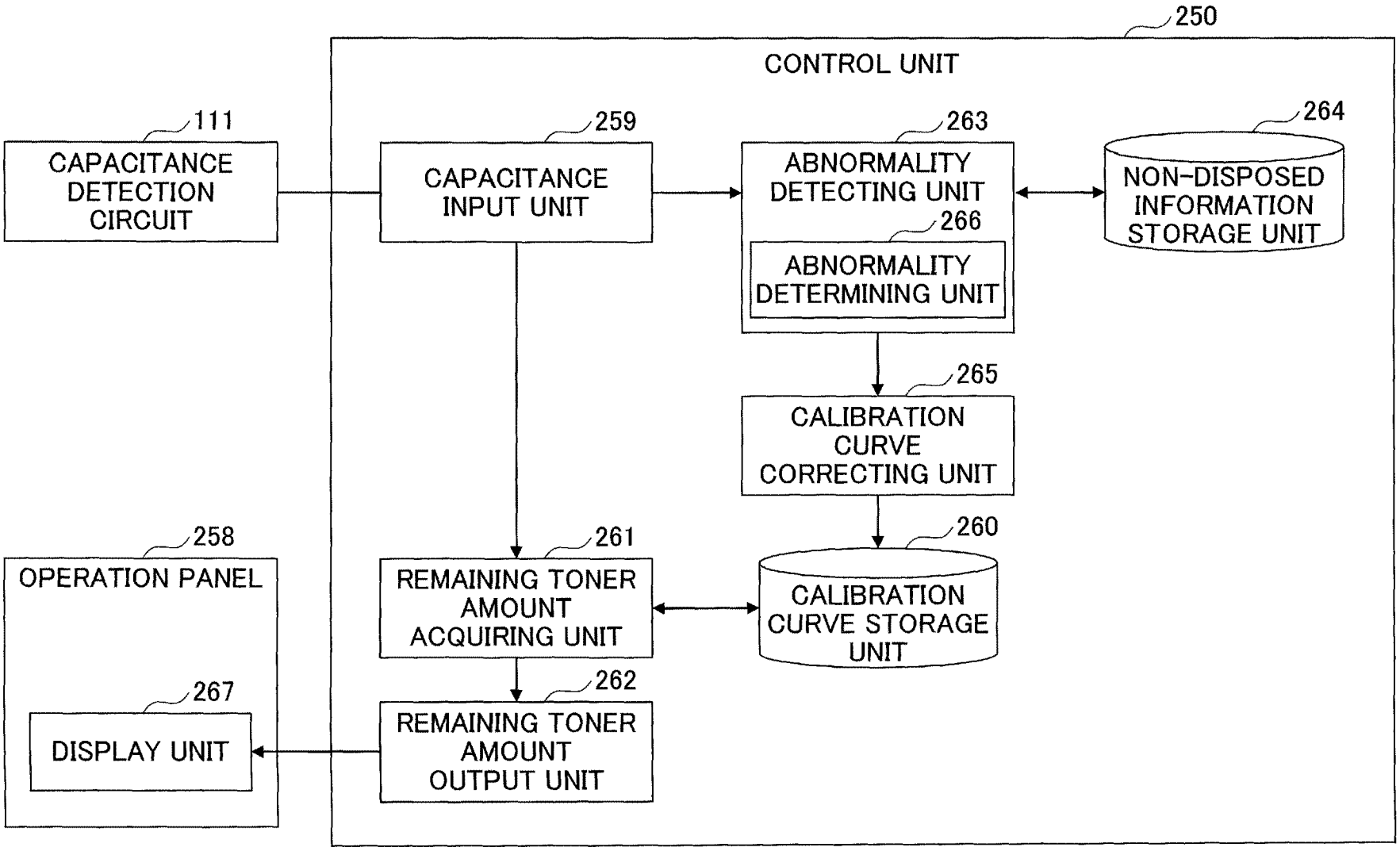
FIG. 9 is a block diagram illustrating an example of a functional configuration of the control unit according to a first embodiment of the present invention.

Functional Configuration of Control Unit of Remaining Toner Amount Detecting Apparatus According to First Embodiment FIG. 9 is a block diagram illustrating an example of a functional configuration of the control unit according to the present embodiment. Note that all of or some of the functional blocks illustrated in FIG. 9 may be configured by functionally or physically distributing and combining the blocks by any unit.

As illustrated in FIG. 9, the control unit 250 includes a capacitance input unit 259, a calibration curve storage unit 260, a remaining toner amount acquiring unit 261, a remaining toner amount output unit 262, an abnormality detecting unit 263, and a non-disposed information storage unit 264.

The capacitance input unit 259, implemented by the sensor I/F 256 and the like, is electrically coupled to the capacitance detection circuit ill, and has a function of inputting a signal representing a detected value of the capacitance and outputting the signal to the remaining toner amount acquiring unit 261 and the abnormality detecting unit 263.

The calibration curve storage unit 260 implemented by the NVRAM 254 and the like stores the data of the calibration curve acquired in advance. The remaining toner amount acquiring unit 261 has a function of acquiring the remaining toner amount by referring to the data of the calibration curve stored in the calibration curve storage unit 260 based on the detected value of the capacitance input from the capacitance input unit 259.

The remaining toner amount acquiring unit 261 outputs a signal representing the acquired remaining toner amount to the remaining toner amount output unit 262 implemented by the operation panel I/F 255 and the like, and the remaining toner amount output unit 262 outputs the signal representing the input remaining toner amount to the operation panel 258 of the image forming apparatus 100. Accordingly, the display unit 267 provided in the operation panel 258 can display the detected remaining toner amount.

Further, the non-disposed information storage unit 264 implemented by the NVRAM 254 and the like, stores the capacitance initial value detected in advance in a non-disposed state in which the toner container 32 is not disposed between the parallel plate electrodes 65 and 66.

The abnormality detecting unit 263 can detect an abnormality in which a foreign object, which is not a detection target and which causes a variation in the capacitance, is interposed between the parallel plate electrodes 65 and 66. This abnormality is detected based on the capacitance initial value acquired from the non-disposed information storage unit 264 and the capacitance inspection value detected by the capacitance detection circuit 111 at the time of inspection and the like.

Specifically, the abnormality detecting unit 263 includes an abnormality determining unit 266, and the abnormality determining unit 266 compares the capacitance initial value with the capacitance inspection value and determines whether a difference value S between these values is greater than or equal to an abnormality threshold value set in advance. The abnormality detecting unit 263 detects an abnormality of the remaining toner amount detecting apparatus 200 when the abnormality determining unit 266 determines that the difference value S is greater than or equal to the abnormality threshold value. When an abnormality is detected, the abnormality detecting unit 263 outputs the difference value S to a calibration curve correcting unit 265.

Further, the calibration curve correcting unit 265 has a function of correcting the calibration curve 201 based on the difference value S input from the abnormality detecting unit 263.

When a foreign object, such as the leaked toner 321, is interposed between the parallel plate electrodes 65 and 66, the detected capacitance increases, and the difference value S corresponds to this increase. Therefore, the calibration curve correcting unit 265 shifts the entire data of the calibration curve, which has been acquired by referring to the calibration curve storage unit 260, by the difference value S in the direction of increasing the capacitance. When the calibration curve is represented by a primary equation, the calibration curve correcting unit 265 increases the intercept by the difference value S while maintaining the slope of the primary equation.

Figure 10:
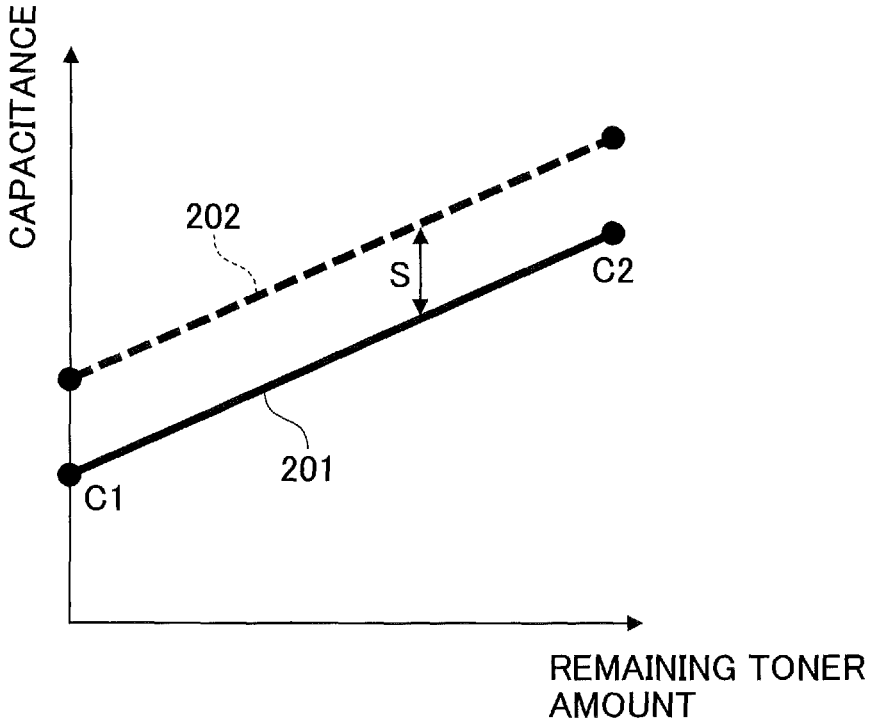
FIG. 10 is a diagram illustrating an example of a calibration curve correction method according to the first embodiment of the present invention.

FIG. 10 is a diagram illustrating an example of a method of correcting a calibration curve by the calibration curve correcting unit 265. The way of viewing the figure is similar to that in FIG. 6, and in FIG. 10, the calibration curve 201 and a calibration curve 202 are illustrated. As illustrated in FIG. 10, the calibration curve 202 is shifted by the difference value S in the direction of increasing the capacitance, with respect to the calibration curve 201.

Figure 11:
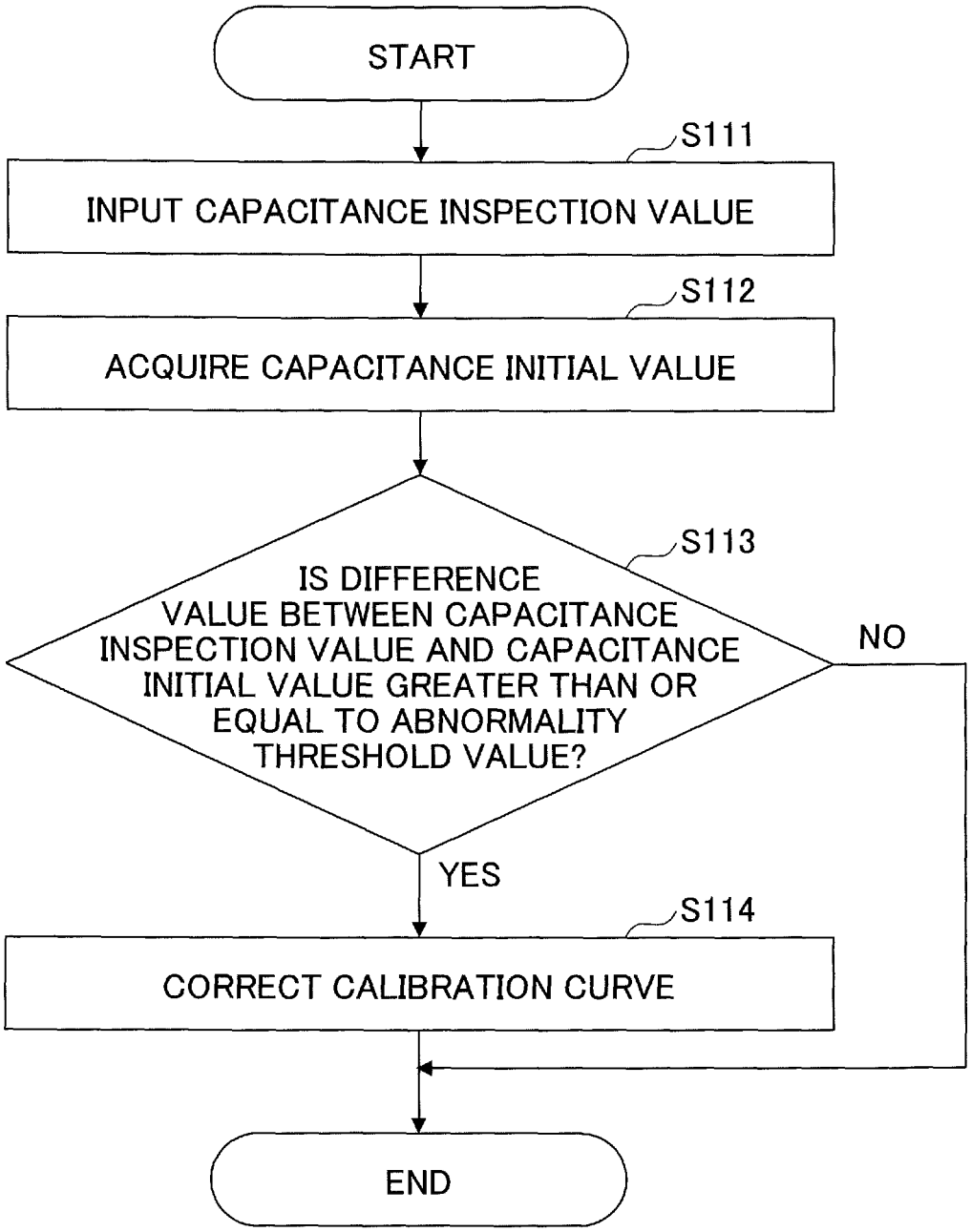
FIG. 11 is a flowchart illustrating an example of a process of detecting an abnormality by the control unit according to the first embodiment of the present invention.

FIG. 11 is a flowchart illustrating an example of an abnormality detection process performed by the control unit according to the present embodiment. Prior to the process illustrated in FIG. 11, the toner container 32 is removed from the toner container housing unit 70 to be in a non-disposed state.

First, in step S111, the capacitance input unit 259 inputs the detected value of the capacitance from the capacitance detection circuit 111 as the capacitance inspection value, and outputs a signal representing the capacitance inspection value to the abnormality detecting unit 263.

Subsequently, in step S112, the abnormality detecting unit 263 acquires the capacitance initial value by referring to the non-disposed information storage unit 264.

Subsequently, in step S113, the abnormality determining unit 266 compares the capacitance inspection value with the capacitance initial value to determine whether the difference value S between these values is greater than or equal to the abnormality threshold value.

Subsequently, in step S113, when it is determined that the difference value S is greater than or equal to the abnormality threshold value (YES in step S113), the abnormality detecting unit 263 outputs the difference value S to the calibration curve correcting unit 265.

Subsequently, in step S114, the calibration curve correcting unit 265 shifts the calibration curve in the direction of increasing the capacitance, by the amount of the input difference value. Accordingly, the calibration curve is corrected.

In contrast, in step S113, when it is determined that the difference value S is not greater than or equal to the abnormality threshold value (NO in step S113), the control unit 250 determines that there is no abnormality in the remaining toner amount detecting apparatus 200 and ends the process.

In this manner, the remaining toner amount detecting apparatus 200 can detect an abnormality caused by a foreign object, which is not a detection target and which causes a variation in the capacitance, interposed between two electrodes. Then, the remaining toner amount detecting apparatus 200 can correct the calibration curve to eliminate the impact of the variation in the capacitance caused by the foreign object.

Figure 12:
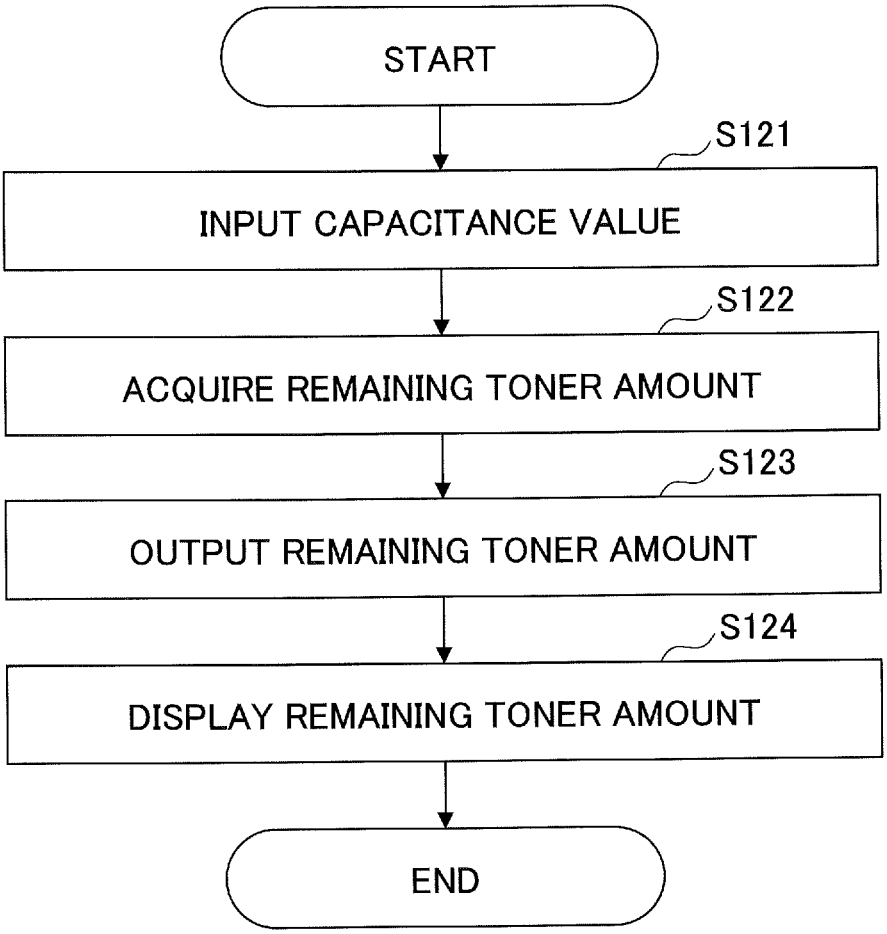
FIG. 12 is a flowchart illustrating an example of a process of detecting a remaining toner amount by the control unit according to the first embodiment of the present invention.

Next, FIG. 12 is a flowchart illustrating an example of a process of detecting the remaining toner amount by the control unit according to the present embodiment.

First, in step S121, the capacitance input unit 259 inputs a signal representing a detected value of the capacitance from the capacitance detection circuit 111 and outputs the signal to the remaining toner amount acquiring unit 261.

Subsequently, in step S122, based on the detected value of the input capacitance, the remaining toner amount acquiring unit 261 acquires the remaining toner amount value by referring to the calibration curve storage unit 260 and outputs a signal representing the remaining toner amount value to the remaining toner amount output unit 262.

Subsequently, in step S123, the remaining toner amount output unit 262 outputs a signal representing the input remaining toner amount value to the operation panel 258.

Subsequently, in step S124, the display unit 267 provided in the operation panel 258 displays the input remaining toner amount value.

In this way, the remaining toner amount detecting apparatus 200 can detect the remaining toner amount and display the remaining toner amount on the display unit 267. According to the present embodiment, the operation panel 258 of the image forming apparatus 100 includes the display unit 267. However, the control unit 250 may include the display unit 267, or a display device having the function of the display unit 267 may be separately provided.

Effect of First Embodiment

As described above, the remaining toner amount detecting apparatus 200 according to the present embodiment includes the non-disposed information storage unit 264 and the abnormality detecting unit 263.

When a foreign object, such as the leaked toner 321 or the metal piece 322, is interposed between the parallel plate electrodes 65 and 66, the difference value between the capacitance initial value and the capacitance inspection value increases, and, therefore, the abnormality detecting unit 263 can detect that a foreign object is intervening by determining whether the difference value is greater than or equal to a predetermined abnormality threshold value.

Further, in the present embodiment, the remaining toner amount output unit 262 and the calibration curve correcting unit 265 are provided. By correcting the calibration curve, the impact of the variation in the capacitance caused by a foreign object can be eliminated. Further, the user can avoid the trouble of acquiring the calibration curve data again, and, therefore, the remaining toner amount can be accurately detected even when a foreign object is interposed between the parallel plate electrodes 65 and 66, without requiring additional effort or time of the user.

Further, in the embodiment, the parallel plate electrodes 65 and 66 are provided on the outside of the toner container 32, and, therefore, the toner can be prevented from sticking to the parallel plate electrodes 65 and 66 and an accurate remaining toner amount can be detected. Further, the number of parts of the toner container 32 can be reduced, and the cost of the toner container 32 can be reduced. Further, an accurate remaining toner amount can be detected even in a high-temperature environment, without being affected by the thermal expansion of the toner container 32.

Further, in the present embodiment, the parallel plate electrodes 65 and 66 cover substantially the entire toner container 32. Accordingly, almost all of the toner in the toner container 32 is included in an electric line of force (electric field) between the two electrodes. Therefore, even when there is uneven distribution of toner in the toner container 32, the remaining toner amount in the toner container 32 can be accurately determined, and the accurate remaining toner amount can be reported to the user.

Second Embodiment

Next, a remaining toner amount detecting apparatus according to a second embodiment will be described. Descriptions of the same configurations as those of the embodiment described above will be omitted.

Compared to the leaked toner 321, the metal piece 322 has a high dielectric constant, and there will be a large variation in the capacitance between the parallel plate electrodes 65 and 66 caused by the metal piece 322. Therefore, when the metal piece 322 is interposed between the parallel plate electrodes 65 and 66, it may be more preferable to remove the metal piece 322, rather than rather than correcting the calibration curve, to restore a more normal detection environment.

Accordingly, in the present embodiment, when the difference value S between the capacitance initial value and the capacitance inspection value is large, it is determined that a foreign object having a high dielectric constant, such as the metal piece 322, is interposed between the parallel plate electrodes 65 and 66, and a report providing an instruction to remove the foreign object is displayed on the display unit 267 so that the user can see the report. When the difference value S between the capacitance initial value and the capacitance inspection value is not large, the foreign object is not removed and the calibration curve is corrected. In this way, the process to be executed can be switched according to the difference value S.

Figure 13:
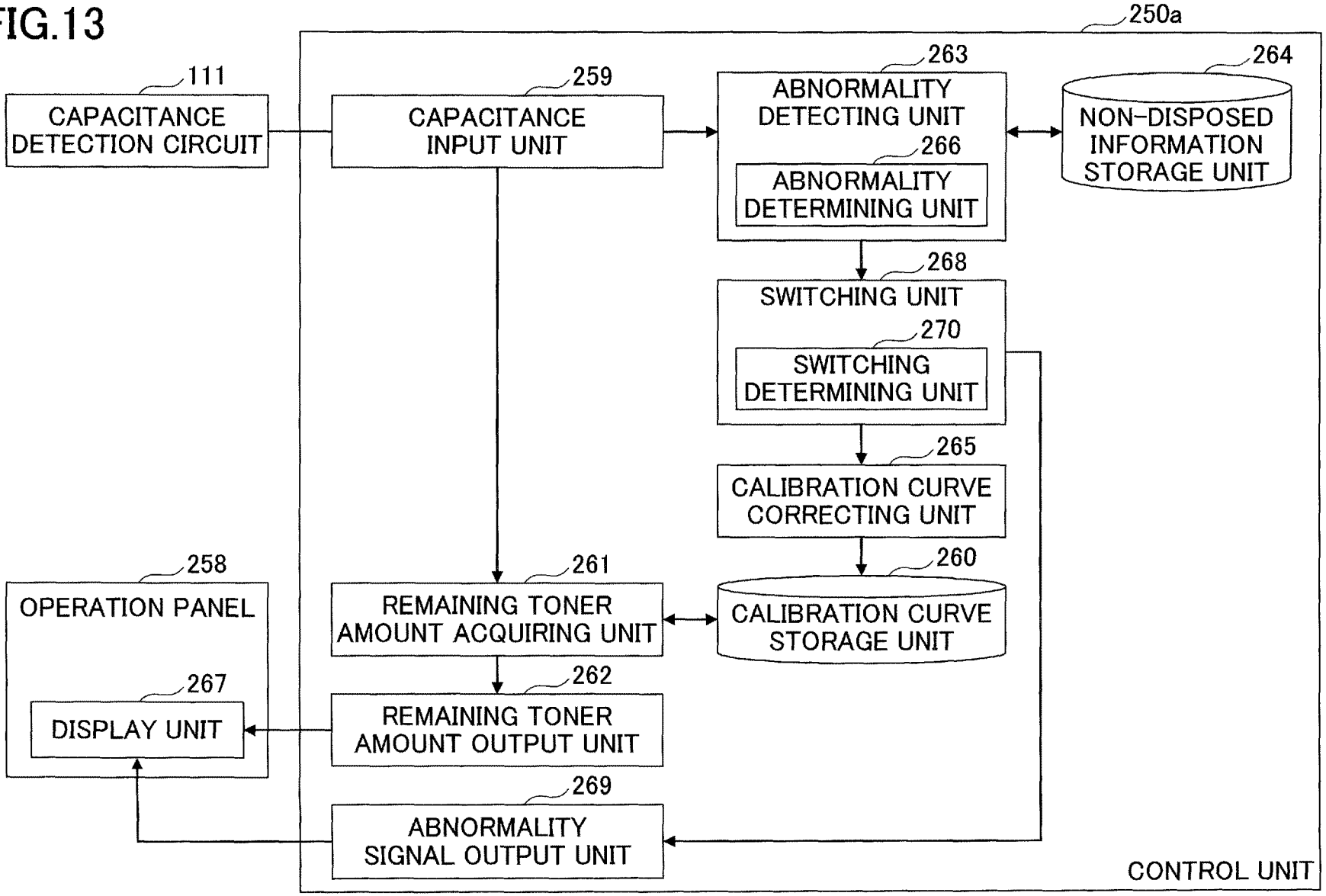
FIG. 13 is a block diagram illustrating an example of a functional configuration of a control unit according to a second embodiment of the present invention.

FIG. 13 is a block diagram illustrating an example of a functional configuration of a control unit according to the present embodiment. As illustrated in FIG. 13, a control unit 250*a* includes a switching unit 268 and an abnormality signal output unit 269.

The switching unit 268 can cause either of the calibration curve correcting unit 265 or the display unit 267 to execute a process based on the difference value S between the capacitance initial value and the capacitance inspection value input from the abnormality detecting unit 263.

Specifically, the switching unit 268 includes a switching determining unit 270, and the switching determining unit 270 compares the capacitance initial value with the capacitance inspection value to determine whether the difference value S between these values is greater than or equal to a predetermined switching threshold value. When the switching determining unit 270 determines that the difference value S is greater than or equal to a predetermined switching threshold value, the switching unit 268 outputs a signal representing a report providing an instruction to remove the cause of the abnormality, to the display unit 267 via the abnormality signal output unit 269. The display unit 267 displays the report.

In contrast, when the switching determining unit 270 determines that the difference value S is not greater than or equal to the switching threshold value, the switching unit 268 outputs a signal representing the difference value S to the calibration curve correcting unit 265. Then, the calibration curve correcting unit 265 can correct the calibration curve.

Figure 14:
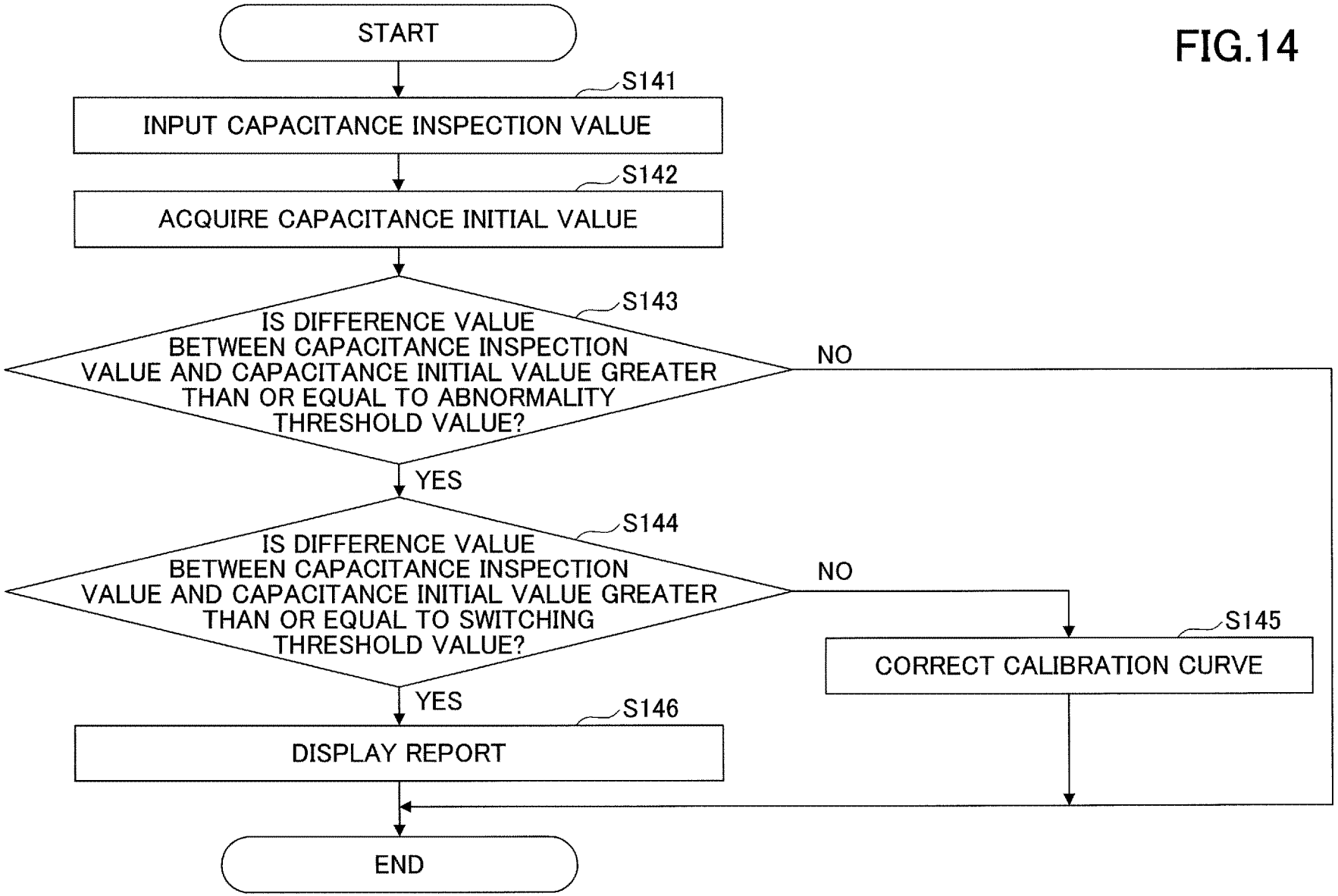
FIG. 14 is a flowchart illustrating an example of a process by the control unit according to the second embodiment of the present invention.

FIG. 14 is a flowchart illustrating an example of a process by the control unit according to the present embodiment. Prior to the process illustrated in FIG. 14, the toner container 32 is removed from the toner container housing unit 70 to be in a non-disposed state. Further, steps S141 to S143 are the same as steps S111 to 113 of FIG. 11, and, therefore, descriptions thereof will be omitted.

In step S144, the switching determining unit 270 determines whether the difference value S is greater than or equal to the switching threshold.

When it is determined in step S144 that the difference value S is not greater than or equal to the predetermined switching threshold value, the switching unit 268 outputs a signal representing the difference value S to the calibration curve correcting unit 265. Then, in step S145, the calibration curve correcting unit 265 shifts the calibration curve in a direction of increasing the capacitance by the amount of the input difference value S, and corrects the calibration curve.

In contrast, when it is determined in step S144 that the difference value S is greater than or equal to the switching threshold value, the switching unit 268 outputs a signal representing a report providing an instruction to remove the cause of the abnormality to the display unit 267 via the abnormality signal output unit 269.

Subsequently, in step S146, the display unit 267 displays the input report.

In this manner, depending on the type of the foreign object, a more appropriate process can be executed.

The process of detecting the remaining toner amount by the control unit 250*a* is the same as that described with reference to FIG. 12, and, therefore, the description thereof will be omitted.

As described above, in the present embodiment, the switching unit 268 is provided. When a foreign object having a high dielectric constant, such as the metal piece 322, is interposed between the parallel plate electrodes 65 and 66, a report providing an instruction to remove the foreign object is displayed. Further, when a foreign object having a low dielectric constant such as the leaked toner 321 is interposed between the parallel plate electrodes 65 and 66, the calibration curve is corrected. Accordingly, depending on the type of the foreign object, a more appropriate process can be executed.

Note that effects other than those described above are the same as those described in the first embodiment.

Further, in the present embodiment, an example of displaying a report providing an instruction to remove a foreign object to the user has been described; however, a report providing an instruction for another countermeasure, such as making a service call, may be displayed.

Although the image forming apparatus according to the embodiments has been described, the present invention is not limited to the above-described embodiments, and various modifications and improvements may be made within the scope of the present invention.

Further, the embodiments also include a method for detecting the remaining toner amount. For example, a remaining toner amount detecting method is performed by a remaining toner amount detecting apparatus including two electrodes, and the remaining toner amount detecting method includes detecting a remaining toner amount in a toner container based on a capacitance between the two electrodes; storing, in a non-disposed information storage, a first capacitance value between the two electrodes detected in advance in a non-disposed state in which the toner container is not disposed between the two electrodes; and detecting an abnormality of the remaining toner amount detecting apparatus based on the first capacitance value stored in the non-disposed information storage and a second capacitance value between the two electrodes detected in the non-disposed state.

By the above-described remaining toner amount detecting method, it is possible to obtain the same effects as the above-described remaining toner amount detecting apparatus.

According to one embodiment of the present invention, it is possible to detect an abnormality that arises when a foreign object, which is not a detection target and which causes a variation in capacitance, is interposed between two electrodes, in an apparatus for detecting the remaining amount of toner in a toner container based on the capacitance between the two electrodes.

The remaining toner amount detecting apparatus, the image forming apparatus, and the remaining toner amount detecting method are not limited to the specific embodiments described in the detailed description, and variations and modifications may be made without departing from the spirit and scope of the present invention.

What is claimed is:

1. A remaining toner amount detecting apparatus comprising:

two electrodes;

a remaining toner amount detector configured to detect a remaining toner amount in a toner container based on a capacitance between the two electrodes;

a storage configured to store a first capacitance value between the two electrodes preliminarily detected in a non-disposed state in which the toner container is not present between the two electrodes; and an abnormality detector configured to detect an abnormality of the remaining toner amount detecting apparatus based on the first capacitance value stored in the storage and a second capacitance value between the two electrodes that is detected in the non-disposed state, wherein the abnormality detector includes:

an abnormality determiner configured to determine whether a difference value between the first capacitance value stored in the storage and the second capacitance value between the two electrodes detected in the non-disposed state, is greater than or equal to a predetermined abnormality threshold value.

2. The remaining toner amount detecting apparatus according to claim 1, further comprising:

a remaining toner amount outputter configured to output a remaining toner amount value based on the capacitance between the two electrodes, the remaining toner amount value being acquired by referring to a calibration curve preliminarily acquired, the calibration curve representing a relationship between the capacitance and the remaining toner amount; and a calibration curve corrector configured to correct the calibration curve based on a difference value between the first capacitance value stored in the storage and the second capacitance value between the two electrodes detected in the non-disposed state, upon detecting the abnormality.

3. The remaining toner amount detecting apparatus according to claim 2, further comprising:

an abnormality signal outputter configured to output a signal representing the abnormality upon detecting the abnormality; and a display configured to display a report providing an instruction to remove a cause of the abnormality.

4. The remaining toner amount detecting apparatus according to claim 3, further comprising:

a switcher configured to cause either one of the calibration curve corrector or the display to execute a process, based on the first capacitance value stored in the storage and the second capacitance value between the two electrodes detected in the non-disposed state.

5. The remaining toner amount detecting apparatus according to claim 4, wherein the switcher includes:

a switching determiner configured to determine whether a difference value between the first capacitance value stored in the storage and the second capacitance value between the two electrodes detected in the non-disposed state, is greater than or equal to a predetermined switching threshold value.

6. An image forming apparatus comprising:

the remaining toner amount detecting apparatus according to claim 1.

7. A remaining toner amount detecting method performed by a remaining toner amount detecting apparatus including two electrodes, the remaining toner amount detecting method comprising:

detecting a remaining toner amount in a toner container based on a capacitance between the two electrodes;

storing, in a storage, a first capacitance value between the two electrodes preliminarily detected in a non-disposed state in which the toner container is not present between the two electrodes; and detecting an abnormality of the remaining toner amount detecting apparatus based on the first capacitance value stored in the storage and a second capacitance value between the two electrodes that is detected in the non-disposed state, wherein the detecting includes:

determining whether a difference value between the first capacitance value stored in the storage and the second capacitance value between the two electrodes detected in the non-disposed state, is greater than or equal to a predetermined abnormality threshold value.

8. A remaining toner amount detecting apparatus comprising:

two electrodes;

a remaining toner amount detecting means for detecting a remaining toner amount in a toner container based on a capacitance between the two electrodes;

a non-disposed information storing means for storing a first capacitance value between the two electrodes preliminarily detected in a non-disposed state in which the toner container is not present between the two electrodes; and an abnormality detecting means for detecting an abnormality of the remaining toner amount detecting apparatus based on the first capacitance value stored in the non-disposed information storing means and a second capacitance value between the two electrodes that is detected in the non-disposed state, wherein the abnormality detector means includes:

an abnormality determining means configured to determine whether a difference value between the first capacitance value stored in the storage and the second capacitance value between the two electrodes detected in the non-disposed state, is greater than or equal to a predetermined abnormality threshold value.

9. The remaining toner amount detecting apparatus according to claim 1, wherein the first capacitance is an initial capacitance value preliminarily detected between the two electrodes without the toner container and the second capacitance is detected at a time of inspection of the toner container after detecting the first capacitance.

* * * * *